US005512128A

United States Patent [19]

Manusch et al.

[11] Patent Number: 5,512,128

[45] Date of Patent: Apr. 30, 1996

[54] EASY-LOAD FILM APPLICATOR

[75] Inventors: Christoph Manusch, Hemmingen; Udo Obersteller, Langenhagen; Wulf Herrmannsen, Ronnenberg, all of Germany

[73] Assignee: Pritt Produktionsgesellschaft mbH, Hanover, Germany

[21] Appl. No.: 270,155

[22] Filed: Jul. 1, 1994

[30] Foreign Application Priority Data

Jul. 2, 1993 [DE] Germany ..... 43 22 118.1

[51] Int. Cl.[6] ..... B32B 35/00

[52] U.S. Cl. ..... 156/577; 156/540; 156/579

[58] Field of Search ..... 156/523, 527, 156/574, 577, 579, 540, DIG. 48

[56] References Cited

U.S. PATENT DOCUMENTS

| | | | |
|---|---|---|---|
| 4,704,185 | 11/1987 | Fischer | 156/579 X |
| 5,281,298 | 1/1994 | Poisson et al. | 156/523 X |
| 5,310,437 | 5/1994 | Tucker | 156/579 X |
| 5,346,580 | 9/1994 | Elges et al. | 156/579 X |

FOREIGN PATENT DOCUMENTS

| | | |
|---|---|---|
| 0386500A1 | 9/1990 | European Pat. Off. . |
| 0575790A1 | 12/1993 | European Pat. Off. . |

*Primary Examiner*—James Engel

*Attorney, Agent, or Firm*—Herbert Dubno; Andrew Wilford

[57] ABSTRACT

An applicator for a film carried on a tape has a housing having a main part and a cover part that normally fit complementarily together. A supply spool on which the tape carrying the film is wound is rotatable in the main housing part. A takeup spool onto which the tape is wound is rotatable in the main housing part adjacent the supply spool. A slide is displaceable longitudinally in the housing between a retracted inner end position relatively close to the spools and an extended outer end position relatively far from the spools and projecting from the housing. The tape is spanned over an applicator foot fixed on and displaceable with the slide. Structure on the housing releasably retains the foot and slide in the front extended position. The spools can be replaced by removing the housing cover part and then pushing the foot back into the inner end position, thereby taking all tension off the tape. The two spools are then removed and a new set of spools joined by a new tape are set in place. The new tape is hooked over the retracted foot and same is pushed into the outer end position, thereby tensioning the tape. The cover part is reinstalled and the reloading is complete.

13 Claims, 3 Drawing Sheets

EASY-LOAD FILM APPLICATOR

FIELD OF THE INVENTION

The present invention relates to a film applicator. More particularly this invention concerns a film applicator where a film is pulled from a backing tape as it is used and the backing tape is automatically wound back up in the applicator.

BACKGROUND OF THE INVENTION

A standard hand-operated device for transferring a film from a carrier tape to a substrate as described in commonly owned U.S. Pat. Nos. 4,849,064 and 4,853,074 has a housing made of two parts that are pivoted together. The housing has two rotatable spindles coupled to each other by a slip-permitting transmission. A cartridge is held in this housing and has fitting on the pivot pins a supply spool and a takeup spool for the tape and an applicator element at one end. The tape passes from the supply spool over the applicator element which is used to press the tape against the substrate for transfer of the film from the tape to the substrate. After the film is stripped from the tape, this tape is wound up on the takeup spool which itself is provided with a one-way brake allowing it to rotate only in one direction.

In such a system the cartridge contains the supply spool, the takeup spool, and the applicator foot so that putting a new supply of tape into the applicator is a fairly simple job. The cartridge is, however, fairly expensive since in effect it constitutes part of the applicator. Furthermore the bulky cartridge must be accommodated in the housing of the applicator, making the applicator somewhat bulkier than it really needs to be.

Thus it is known to dispense with the cartridge and to supply replacement tape as a pair of coaxial spools that are interconnected by a small loop of tape extending from the supply spool to the takeup spool. The old spool assembly is stripped out of the housing, then the new one is fitted in place. The user must then carefully pull out the loop of tape to span it over the applicator foot. If too much tape is pulled out, the takeup spool must be rotated to eliminate the slack.

This is a relatively onerous operation requiring the user to exercise some care. If the slack is not eliminated the applicator will not work. Similarly if the takeup spool is rotated in the wrong direction, more slack will be formed during the first several uses. In general such a reloading system is not ideal in a mass-marketed office product.

OBJECTS OF THE INVENTION

It is therefore an object of the present invention to provide an improved tape applicator.

Another object is the provision of such an improved tape applicator which overcomes the above-given disadvantages, that is which is easy to load but that does not use an expensive cartridge.

SUMMARY OF THE INVENTION

An applicator for a film carried on a tape has according to the invention a housing having a main or base part and a cover part that normally fit complementarily together. A supply spool on which the tape carrying the film is wound is rotatable in the main housing part. A takeup spool onto which the tape is wound is rotatable in the main housing part adjacent the supply spool. A slide is displaceable longitudinally in the housing between a retracted inner end position relatively close to the spools and an extended outer end position relatively far from the spools and projecting from the housing. The tape is spanned over an applicator foot fixed on and displaceable with the slide. Structure on the housing releasably retains the foot and slide in the front extended position.

Thus according to this invention the spools can be replaced by removing the housing cover part and then pushing the foot back into the inner end position, thereby taking all tension off the tape. The two spools are then removed and a new set of spools joined by a new tape are set in place. The new tape is hooked over the retracted foot and same is pushed into the outer end position, thereby tensioning the tape. The cover part is reinstalled and the reloading is complete. Even a relatively clumsy or mechanically inept person can do this easily.

The applicator further has according to the invention a formation on the cover part for retaining the slide and foot in the extended outer position when the cover part is fitted to the main part. Another formation can prevent installation of the cover part when the slide is in the inner end position.

The main part in accordance with this invention is formed with a longitudinally extending guide rail along which the slide is displaceable. This guide rail is generally of T-section and the slide fits complementarily to it.

The slide is provided with at least one laterally deflectable spring arm and the main housing part is provided with inner and outer seats in which the arm is engageable in the inner and outer positions of the slide. In fact two such spring arms and pairs of seats can be provided. The arms are unitarily formed with the slide and foot and each of the arms is provided with a laterally upstanding projection adapted to be gripped to pull the arms toward each other and out of the seats.

The main housing part is symmetrical to a plane bisecting the spools and parallel to which the slide is movable between its end positions. In addition the foot is laterally limitedly deflectable at least in its outer end position. An abutment on the housing can limit this lateral deflection. The housing can be formed with another abutment against which the slide bears longitudinally in the inner end position.

BRIEF DESCRIPTION OF THE DRAWING

The above and other objects, features, and advantages will become more readily apparent from the following description, reference being made to the accompanying drawing in which.

SPECIFIC DESCRIPTION

Figure 1:
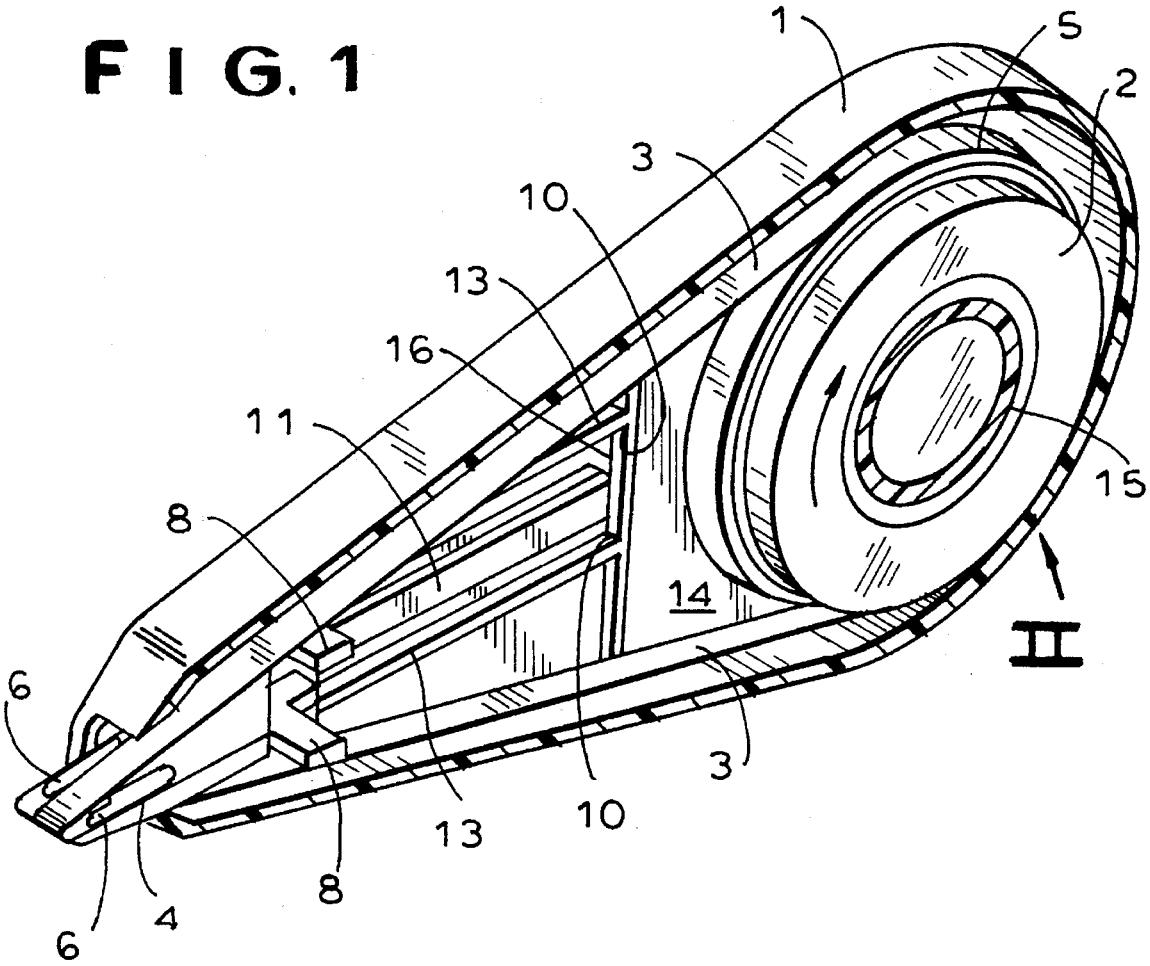
FIG. 1 is a perspective view of the applicator with the cover housing half removed for clarity of view.
Figure 6:
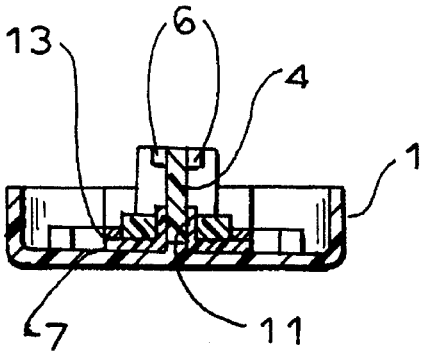
FIGS. 5 and 6 are sections taken along respective lines V—V and VI—VI of FIG. 4.
Figure 2:
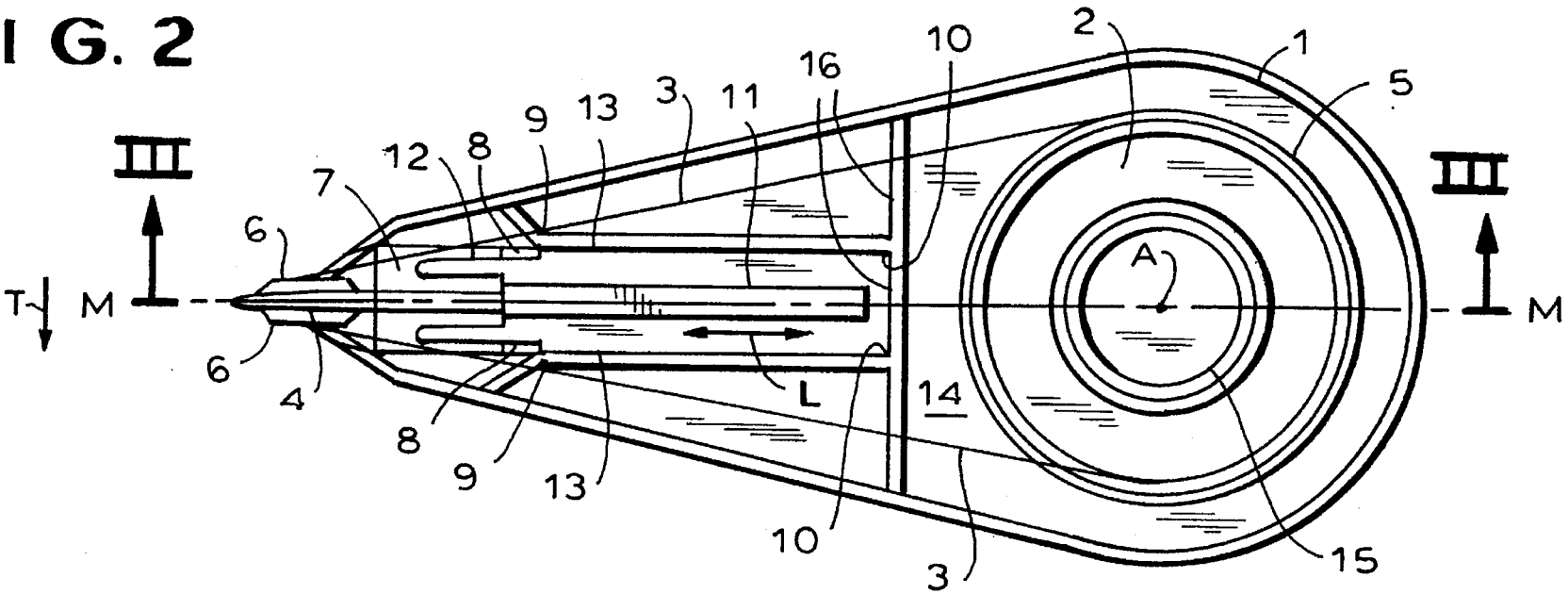
FIG. 2 is a side view taken in the direction of arrow II of FIG. 1.
Figure 3:
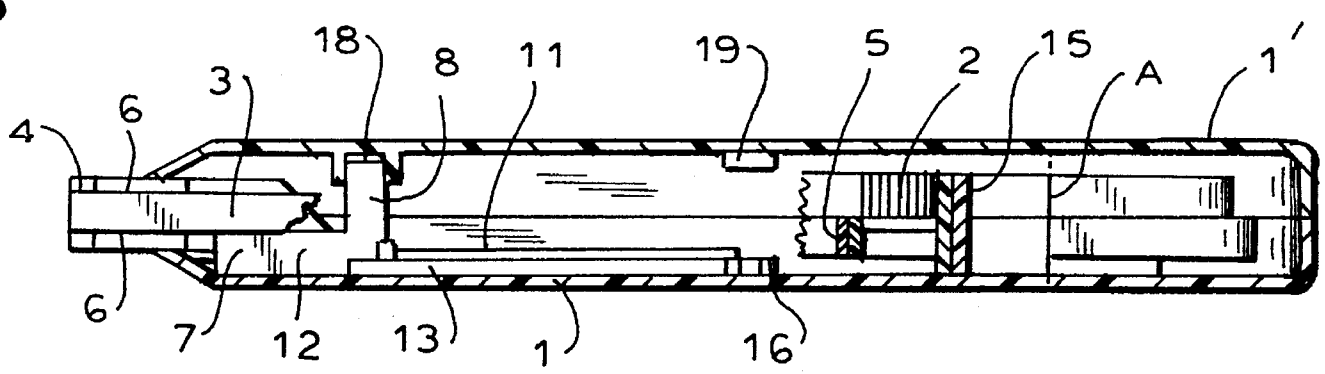
FIG. 3 is a section taken along line III—III of FIG. 2 with the cover part in place.
Figure 4:
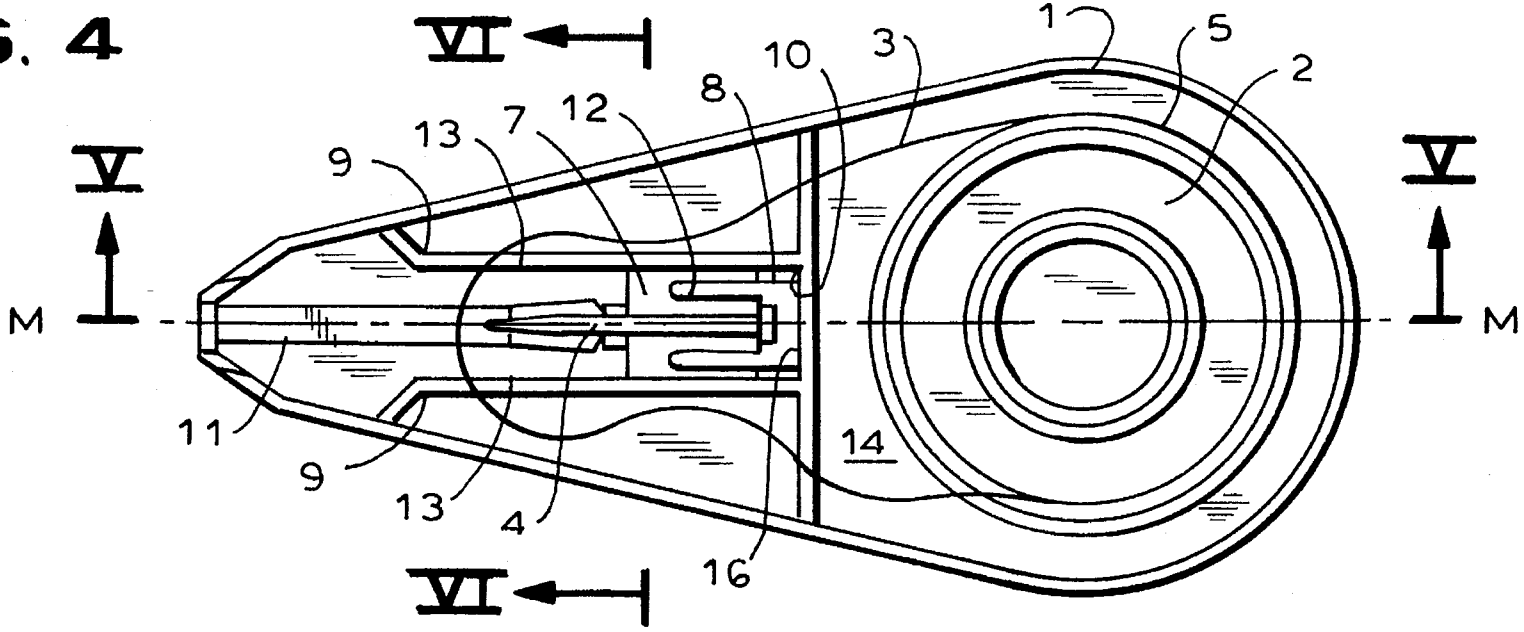
FIG. 4 is a view like FIG. 2 but with the applicator foot retracted.
Figure 5:
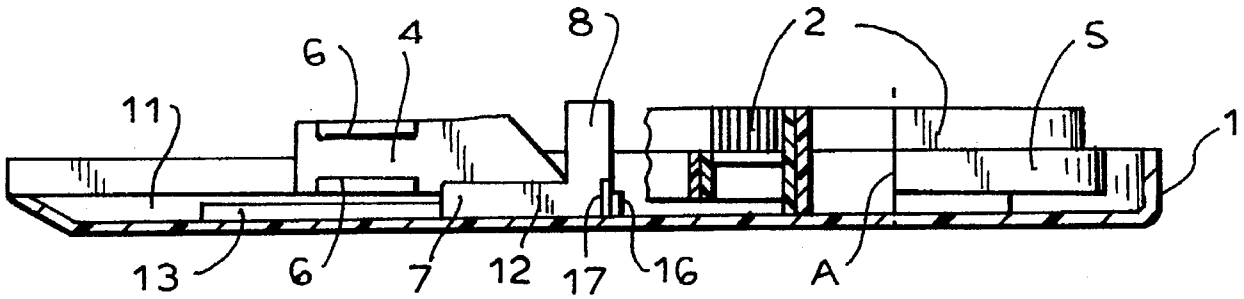

As seen in FIGS. 1 through 6 a film applicator according to this invention has a main housing part 1 and a cover housing part 1' that together form a closed housing adapted to be held in the hand. The part 1 is formed with a circular hub 15 that normally carries a supply spool 2 of tape 3 that passes over an applicator foot 4 and that is wound up on a takeup spool 5 also carried on the hub 15. The foot 4 is formed on each of its faces with a pair of laterally spaced guide bumps 6 that keep the tape 3 on center. The two spools 2 and 5 are coaxial to a common axis A.

According to the invention the foot 4 is formed as part of a slide 7 that can move longitudinally in the housing part 1 in direction L along a T-section guide rail 11 that it fits complementarily to. This slide 7 in unitarily molded of a durable synthetic resin with a pair of spring arms 12 with ends 17 that engage in respective outer and inner positions of the slide 7 in respective outer notches 9 or inner notches 10 formed in longitudinally extending webs 13 of the part 1. Each of these unitary spring arms 12 is provided with an upstanding projection 8 (see FIG. 5). In the inner or rear position shown in FIGS. 4–6 the rear ends of the spring arms 12 abut a crosswise web 16 that defines in the housing part 1 a compartment 14 in which the spools 2 and 5 are held. The cover part 1' is formed with sockets 18 that fit over the projections 8 in the extended outer position and with bumps 19 that prevent the cover 1' from being mounted on the base 1 with the slide 7 in the retracted position.

During normal use of the applicator the foot 4 is pressed against a substrate and the whole device is moved transversely in direction T so that a film carried by the tape 3 is transferred from it to the substrate and the film-free carrier part of the tape 3 is wound up on the takeup spool 5. The foot 4 is centered on a symmetry plane M—M of the device so that as the one spool 2 gets smaller and the other larger, the tape 3 moves perfectly uniformly and symmetrically over the foot 4.

When the tape 3 on the supply spool 2 is exhausted the cover part 1' is removed, normally by undoing a screw at the axis A. Then the two projections 8 are grasped between the thumb and forefinger and pressed together and the slide 7 is moved from the outer or front position of FIGS. 1 through 3 to the back position of FIGS. 4 through 6, moving the arm ends 17 from the notches 9 to the notches 10. This causes the loop of tape 3 engaged tautly over the foot 4 to become slack as illustrated. The two joined-together coaxial spools 2 and 5, the former empty and the latter full, are then picked off the hub 15.

Then a new pair of spools 2 and 5, the former full and the latter empty, are set in place in the supply compartment and the loop of tape 3 connecting them is hooked loosely over the retracted foot 4. The user then grasps the two projections 8 and presses them together to free the slide 7, and moves it back out to the front position of FIGS. 1 through 3. This action pulls some more tape 3 off the supply spool 2 and leaves the tape 3 tautly spanned around the foot 4. The cover 1' is reinstalled and the applicator is ready to use again.

We claim:

1. An applicator for a film carried on a tape, the applicator comprising:

a housing having a base part and a cover part that fit together;

a supply spool on which the tape carrying the film is wound, the supply spool being rotatable in the base housing part about an axis fixed in the base part;

a takeup spool onto which the tape is wound, the takeup spool being rotatable in the base housing part adjacent the supply spool about an axis fixed in the base part;

a slide displaceable longitudinally in the housing relative to the spools between a retracted inner end position relatively close to the spools and an extended outer end position relatively far from the spools and projecting from the housing;

an applicator foot fixed on and displaceable with the slide, the tape being spanned over the foot; and means on the housing for releasably retaining the foot and slide in the front extended position.

2. The applicator defined in claim 1, further comprising means including a formation on the cover part for retaining the slide and foot in the extended outer position when the cover part is fitted to the base part.

3. The applicator defined in claim 1 wherein the base part is formed with a longitudinally extending guide rail along which the slide is displaceable.

4. The applicator defined in claim 3 wherein the guide rail is generally of T-section and the slide fits complementarily to it.

5. The applicator defined in claim 1 wherein the slide is provided with at least one laterally deflectable spring arm and the base housing part is provided with inner and outer seats in which the arm is engageable in the inner and outer positions of the slide.

6. The applicator defined in claim 1 wherein the slide is provided with a pair of laterally deflectable oppositely spring arms and the base housing part is provided with respective pairs of inner and outer seats in which the arms are engageable in the inner and outer positions of the slide.

7. The applicator defined in claim 6 wherein the arms are unitarily formed with the slide and foot.

8. The applicator defined in claim 6 wherein each of the arms is provided with a laterally upstanding projection adapted to be gripped to pull the arms toward each other and out of the seats.

9. The applicator defined in claim 1 wherein the base housing part is symmetrical to a plane bisecting the spools and parallel to which the slide is movable between its end positions.

10. The applicator defined in claim 1 wherein the foot is laterally limitedly deflectable at least in its outer end position.

11. The applicator defined in claim 1 wherein the housing is formed with an abutment against which the slide bears longitudinally in the inner end position.

12. An applicator for a film carried on a tape, the applicator comprising:

a housing having a base part and a cover part that fit together;

a supply spool on which the tape carrying the film is wound, the supply spool being rotatable in the base housing part;

a takeup spool onto which the tape is wound, the takeup spool being rotatable in the base housing part adjacent the supply spool;

a slide displaceable longitudinally in the housing between a retracted inner end position relatively close to the spools and an extended outer end position relatively far from the spools and projecting from the housing;

an applicator foot fixed on and displaceable with the slide, the tape being spanned over the foot; and means on the housing for retaining the foot and slide in the front extended position when the housing parts are fitted together and for permitting the foot and slide to move into the inner end position when the cover part is separated from the base part.

13. The applicator defined in claim 12 wherein the retaining means includes interengaging formations on the cover part and slide that fit together when the cover part is fitted to the base part.

* * * * *